US009279650B2

(12) United States Patent
Mackey, Jr. et al.

(10) Patent No.: US 9,279,650 B2
(45) Date of Patent: Mar. 8, 2016

(54) CROSSBOW BOLT HAVING A REAR DEPLOYABLE CUTTER DEVICE AND PRACTICE BOLT FOR SIMULATING THE SAME

(71) Applicants: James F. Mackey, Jr., Tewksbury, MA (US); Joseph M. Camara, Salem, NH (US)

(72) Inventors: James F. Mackey, Jr., Tewksbury, MA (US); Joseph M. Camara, Salem, NH (US)

( * ) Notice: Subject to any disclaimer, the term of this patent is extended or adjusted under 35 U.S.C. 154(b) by 0 days.

(21) Appl. No.: 14/645,810

(22) Filed: Mar. 12, 2015

(65) Prior Publication Data

US 2015/0260492 A1 Sep. 17, 2015

Related U.S. Application Data

(60) Provisional application No. 61/952,284, filed on Mar. 13, 2014.

(51) Int. Cl.
*F42B 6/06* (2006.01)
*F42B 12/34* (2006.01)

(52) U.S. Cl.
CPC .. *F42B 6/06* (2013.01); *F42B 12/34* (2013.01)

(58) Field of Classification Search
CPC ..... F42B 6/04; F42B 6/06; F42B 6/08
See application file for complete search history.

(56) References Cited

U.S. PATENT DOCUMENTS 3,790,948 A 2/1974 Ratkovich
4,488,728 A 12/1984 Humphrey
4,675,683 A 6/1987 Robinson et al.
4,749,198 A 6/1988 Brailean
4,858,935 A 8/1989 Capson
4,885,800 A 12/1989 Ragle
4,940,245 A 7/1990 Bittle, Jr.
RE33,470 E 12/1990 Boy et al.
4,976,442 A 12/1990 Treadway
5,022,658 A 6/1991 Burkhart
5,157,405 A 10/1992 Wycoff et al.
5,167,417 A 12/1992 Stacey et al.
5,188,373 A 2/1993 Ferguson et al.
5,314,196 A * 5/1994 Ruelle ..... F42B 6/04 473/578
5,427,384 A 6/1995 Saunders
5,450,614 A 9/1995 Rodriguez
6,409,617 B1 6/2002 Armold
6,612,947 B2 9/2003 Porter
6,814,678 B2 11/2004 Cyr et al.
6,856,250 B2 2/2005 Hilliard
7,232,389 B2 6/2007 Monteleone
7,300,367 B1 11/2007 Andol et al.
7,632,199 B2 12/2009 Kikos (Continued)

OTHER PUBLICATIONS

Photo of Shrink Fletch Packaging, product available prior to Oct. 2, 2008.

(Continued)

*Primary Examiner* — John Ricci
(74) *Attorney, Agent, or Firm* — Preti Flaherty Beliveau & Pachios LLP

(57) ABSTRACT

An arrow having a forward portion and an aft portion. The aft portion includes a necked down region having a diameter less than the diameter of the frontal portion. A cutter device includes one or more blades and is mountable along the necked down region of the aft portion. A tube having a plurality of vanes is disposed over the blades during arrow flight and is slidable rearward to allow the blades to deploy outward upon engagement of the vanes with a target.

8 Claims, 9 Drawing Sheets

(56) References Cited

U.S. PATENT DOCUMENTS

| | | | | |
|---|---|---|---|---|
| 7,909,714 | B2 | 3/2011 | Cyr et al. | |
| 8,079,926 | B2 | 12/2011 | Mackey, Jr. et al. | |
| 8,475,302 | B1 * | 7/2013 | Hummel, III | F42B 6/04 473/578 |
| 2002/0091023 | A1 | 7/2002 | Porter | |
| 2005/0178375 | A1 | 8/2005 | Sutherland et al. | |
| 2006/0089216 | A1 | 4/2006 | Monteleone | |
| 2007/0105668 | A1 | 5/2007 | Kikos | |
| 2008/0248903 | A1 | 10/2008 | Cyr et al. | |
| 2008/0248904 | A1 | 10/2008 | Cyr et al. | |

OTHER PUBLICATIONS

Pages from Red Head, Archery 2008 Specialists Catalog, By: Bass Pro Shops.
Pages from Cabela's 2008 Edition Archery Catalog.

* cited by examiner

CROSSBOW BOLT HAVING A REAR DEPLOYABLE CUTTER DEVICE AND PRACTICE BOLT FOR SIMULATING THE SAME

STATEMENT REGARDING FEDERALLY SPONSORED RESEARCH OR DEVELOPMENT

Not Applicable

BACKGROUND OF THE INVENTION

The present invention pertains to hunting arrows and more specifically to a crossbow arrow or bolt having cutter blades deployable from the aft portion of the arrow.

Bow hunting has become a popular sport and involves the use of specialized equipment. As well known, bow hunters utilize vertical type bows (such as long bows, recurve bows, and compound vertical bows) and crossbows. The arrows employed with vertical type bows and crossbows have many similarities and several differences. Typically, arrows employed with vertical type bows are longer than arrows employed with crossbows. Additionally, the diameter of arrows used with crossbows, which are also known as bolts, are typically greater than the diameter of arrows used with vertical type bows.

When hunting with a bow and arrow, it is generally understood that it is desirable to create an entry and an exit wound in a target animal. By creating an entry and exit wound, it is likely that bleeding from the wounds will permit the hunter to track and locate the target animal more easily. If the entry and exit wounds close quickly, tracking of the wounded animal may become more difficult and the animal may not be able to be located.

To address this problem, hunting arrows have been provided with broadheads at the forward end of the arrow that have cutter blades which deploy upon impact to produce a larger wound than would be produced without such blades. As a consequence of the deployment of the cutter blades in the broadhead at the forward end of the arrow, larger entry and exit wounds are produced. The size of the blades used in a broadhead, however, is limited in practice by the size of the broadhead. Additionally, if cutter blades at the forward end of an arrow are too large, the broadhead will not be as likely to pass through the target animal and create an exit wound.

U.S. Pat. No. 8,079,926 assigned to the assignee of the present invention discloses a rear mountable cutter device for a hunting arrow in which the cutter device is mounted to a component that is affixed to the rearward end of the arrow. The blades of the cutter device extend forward toward the broadhead. Prior to deployment, the blades are generally disposed along the surface of the arrow shaft and a tube is disposed over the blades to retain the blades in a non-deployed orientation during arrow flight. This embodiment results in a discontinuity in the outer diameter of the arrow shaft between the forward end of the arrow and the rearward end of the arrow due to the presence of the blades and the surrounding tube. This discontinuity is undesirable with respect to arrows or bolts launched by crossbows.

Accordingly, it would be desirable to have an expandable cutter assembly that is mountable to an arrow and that produces an entry wound larger than that typically produced by a conventional broadhead. Additionally, it would be desirable to have an arrow that is suitable for use with crossbows and that produces more substantial internal wounds in a target animal to more quickly cause the demise of the target animal.

BRIEF SUMMARY OF THE INVENTION

A crossbow bolt having a forward portion and an aft portion having a necked down region with a diameter less than the diameter of the forward portion is disclosed. The forward portion is generally tubular and includes a front end that is coupleable to a broadhead and a rearward end. The front end of the aft portion is configured for attachment to the rearward end for the forward portion.

In one embodiment, the front end of the aft portion is configured for attachment to the rearward end of the forward portion via a tubular section that is sized so as to be slidably insertable into the rearward end of the tubular forward portion. The aft portion may be permanently secured to the frontal portion via glue or any other suitable means to form an arrow shaft including the forward and aft portions.

In another embodiment, the rearward end of the forward portion includes a female threaded insert and the front end of the aft portion includes a male threaded stud so as to permit the threaded stud to be screwed into the threaded insert to releasably secure the aft portion to the forward portion of the bolt.

The front end of the aft portion includes a front tubular section having a diameter slightly less than the diameter of the forward portion of the bolt and approximately equal to the inner diameter of the forward portion to allow insertion of the front tubular section into the rearward end for the forward portion. Rearward of the front tubular section, the aft portion includes an annular flange having an outer diameter that is generally equal to the outer diameter of the forward portion. The annular flange limits the insertion depth of the front tubular section into the rearward end of the forward portion. Rearward of the annular flange, the aft portion includes a generally cylindrical section having an outer diameter that is generally equal to the inner diameter of a tube having vanes extending thereon as subsequently discussed. Rearward of the generally cylindrical section, the aft portion includes an elongated necked down region having an outer diameter less than the outer diameter of the generally cylindrical section, so as to permit a cutter device to be mounted within the necked down region as subsequently discussed.

The cutter device includes a generally ring-shaped portion and, in one embodiment, has three (3) blades extending from the ring-shaped portion. The cutter device is mountable within the aft portion by slidably disposing the ring-shaped portion over the rearward end of the aft portion. The forward position of the cutter device within the elongated necked down region is limited by one or more tabs projecting from the necked down region and cooperative with the leading edge of the ring-shaped portion of the cutter device.

The cutter device is retained within the aft portion by an end cap. A tube having vanes extending therefrom is slidably disposed over the aft portion and the end cap so as to encase the cutter device within the tube. The tube extends rearward of the back end of the end cap. A nock includes a generally cylindrical front section having an outer diameter generally equal to the inner diameter of the tube so as to be insertable therein.

When the bolt impacts a target animal, the vanes engage the target animal and slidably urge the tube rearward to expose the blades of the cutter device which are normally biased and splayed outward, thereby permitting the cutter blades to deploy and produce an enlarged wound in the target animal.

Other features, aspects and advantages of the presently disclosed bolt and method for producing the same will be apparent to those of ordinary skill in the art from the present disclosure taken in conjunction with the following Drawings and the Detailed Description of the Invention.

BRIEF DESCRIPTION OF THE SEVERAL VIEWS OF THE DRAWINGS

The invention will be more fully understood by reference to the following Detailed Description of the Invention in conjunction with the Drawings of which.

DETAILED DESCRIPTION OF THE INVENTION

Figure 1:
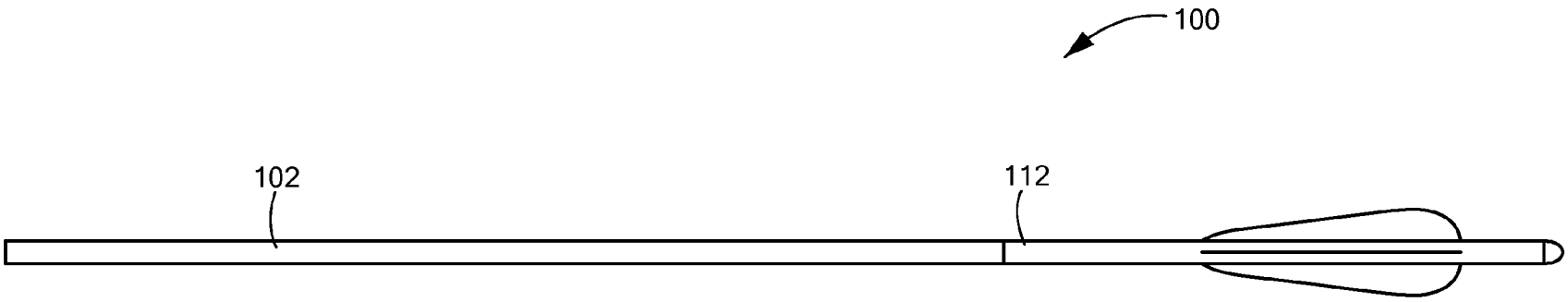
FIG. 1 is side view of an arrow in the form of a crossbow bolt in accordance with the present invention.

An arrow in the form of a crossbow bolt in accordance with the present invention is illustrated in FIGS. 1-10. Referring to FIGS. 1-10, the crossbow bolt 100 includes a forward portion 102 configured for coupling to a broadhead 104, an aft portion 106 having a forward end that is securable to the rearward end of the forward portion 102, a cutter device 108 having deployable blades and an end cap 110 that is securable to the rearward end of the aft portion 106 of the bolt 100. The bolt 100 further includes a tube 112 having vanes extending therefrom. The tube 112 is slidably disposable over the aft portion 106 of the bolt 100, the cutter device 108 and the end cap 110. The rearward end of the tube 112 extends slightly rearward of the back end of the end cap 110 when slidably mounted on the aft portion 106. A nock 114 is mountable in the rearward end of the tube 110.

Figure 2:
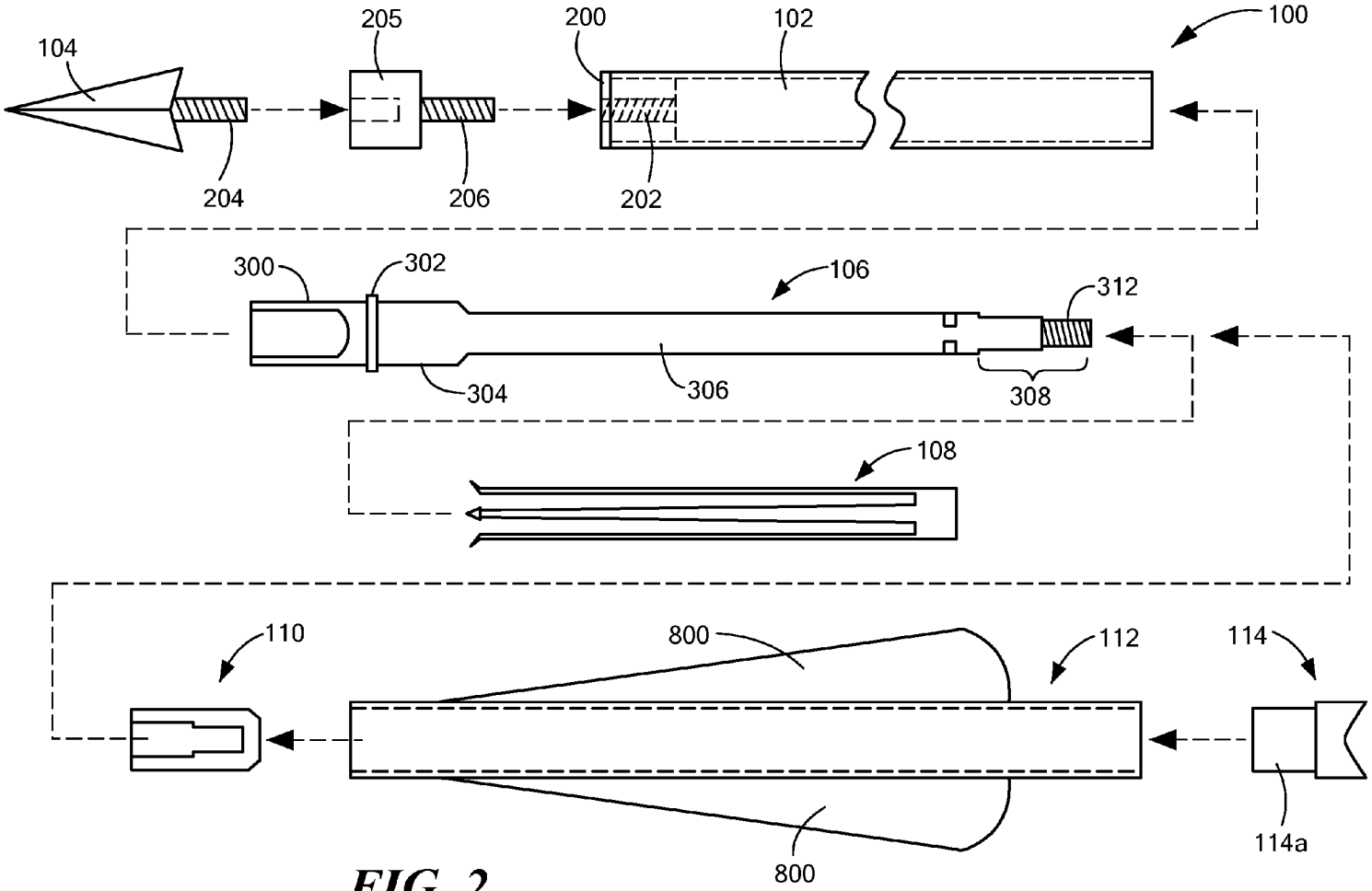
FIG. 2 is a an exploded view of the crossbow bolt of FIG. 1.

Referring to FIG. 2, the forward portion 102 of the bolt 100 is typically tubular. An insert 200 having a threaded opening 202 is mounted in front end of the forward portion 102. The threaded opening 202 in the insert 200 is sized to receive a cooperative threaded stud 204 extending from the rearward end of the broadhead 104 so as to permit the broadhead 104 to be securely and removably mounted to the forward portion 102 of the bolt 100. The rearward end of the forward portion 102 has an inner diameter sized receive a front tubular section 300 of the aft portion 106 as subsequently described. Optionally, a counterweight 205 may be mounted between the broadhead 104 and the forward portion 102 of the bolt 100 to provide appropriate balance between the weighting of the forward and aft portions of the bolt so as to achieve desired flight characteristics. More specifically, the threaded stud 204 of the broadhead may be secured within a threaded opening in the forward end of the counterweight 205 and a threaded stud 206 extending from the rear of the counterweight may be threaded into the threaded opening in the insert 200 to secure the counterweight 205 between the broadhead 104 and the forward portion 102 of the bolt.

Figure 3:
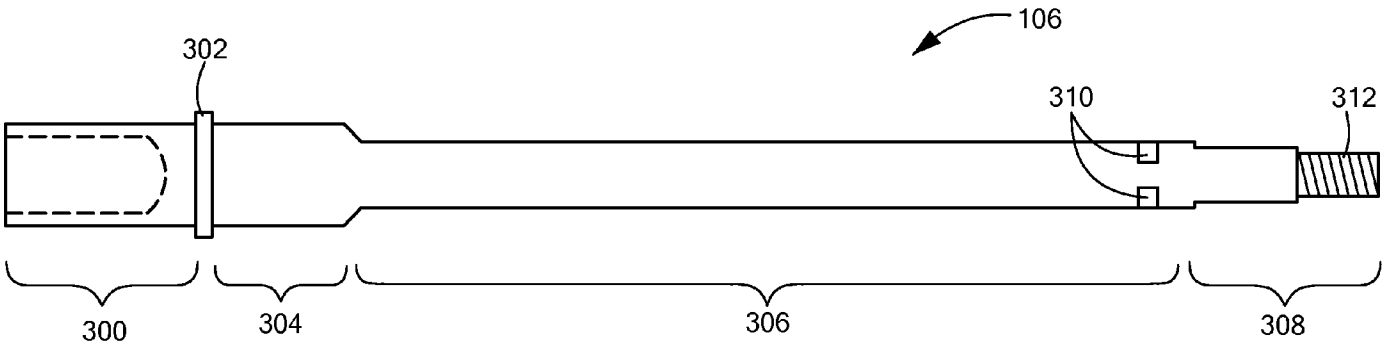
FIG. 3 is a side view of the aft portion of the crossbow bolt of FIG. 1.

The aft portion 106 of the bolt 100 is illustrated in FIG. 3. As illustrated in FIG. 3, the aft portion 106 includes the front tubular section 300, an annular flange 302, a cylindrical section 304, a necked down cutter device mounting region 306 and an end cap mounting section 308. The outer diameter of the front tubular section 300 is sized for a close or press fit with the inner diameter of the rearward end of the forward portion 102 and is glued or otherwise secured, such as via a press fit, within the rearward end of the forward portion 102 to affix the aft portion 106 to the forward portion 102 of the bolt 100. The annular flange 302 has an outer diameter that is substantially the same as the outer diameter of the forward portion 102 so as to avoid a discontinuity in the diameter of the arrow shaft along its length. The flange 302 also provides a positive stop and serves to limit the insertion depth of the front tubular section 300 into the rearward end of the forward portion 102 of the bolt 100. By providing an aft portion 106 that is coupleable to the forward portion 102, forward portions of different lengths may be provided and the aft portion may be mated with a forward portion 102 of a selected length to provide a bolt of a desired length for use with a cooperative crossbow. The forward portion may be provided by cutting a commercially available bolt to obtain a forward portion 102 of a desired length needed to produce a bolt of a desired total length. Alternatively, the forward portion 102 may be manufactured to a specific length needed to achieve the desired bolt length.

The necked down mounting region 306 extends rearward of the cylindrical section 304 and has an outer diameter that is less than the outer diameter of the cylindrical section 304. Thus, an annular space is provided between the outer diameter of the necked down mounting region 306 and the inner diameter of the tube 112 along the length of the necked down mounting region 306 when the tube 112 is disposed over the aft portion 106 of the bolt 100.

Figure 4B:
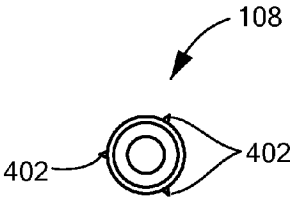
FIG. 4*b* is an end view of the cutter device of FIG. 4*a;*
Figure 4A:
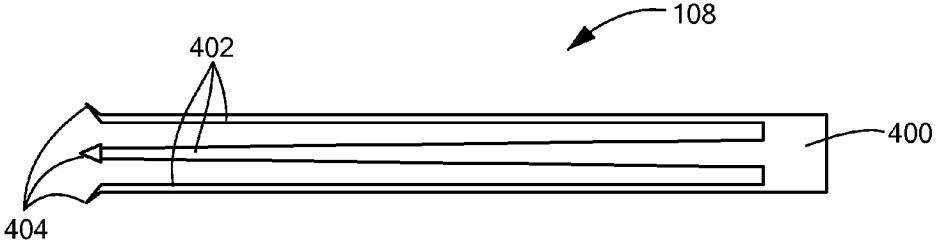
FIG. 4*a* is a side view of the cutter device employed in the crossbow bolt of FIG. 1 with the blades inwardly constrained.
Figure 6:
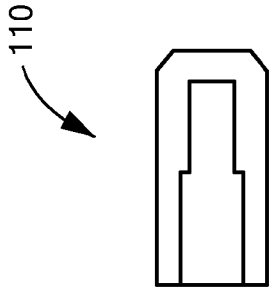
FIG. 6 is a cross-sectional view of the end cap of FIG. 2 which is threadably mountable on the rearward end of the aft portion of the bolt.

FIGS. 4*a* and 4*b* depict the cutter device 108 that is mountable on the aft portion 106 of the crossbow bolt 100. Referring to FIGS. 4*a* and 4*b*, the cutter device 108 includes a ring-shaped portion 400 and one or more blades 402 that extend therefrom. In the illustrated embodiment, the cutter device 108 includes three blades 402 that extend from the ring-shaped portion 400. The ring-shaped portion 400 is slidably disposed over the rearward end of the necked down mounting region 306 such that the blades 402 extend forward along the necked down mounting region toward the cylindrical section 304. The blades 402 may be serrated along all or a portion of their length and terminate in an outwardly angled barb 404.

Figure 5:
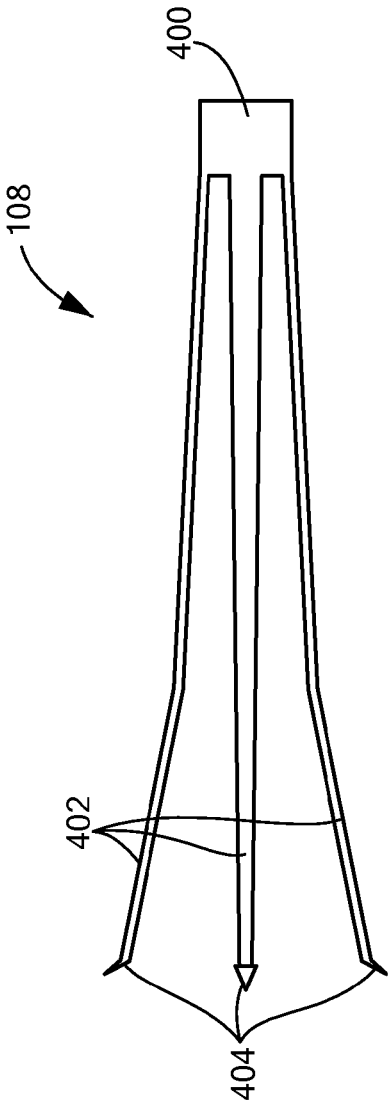
FIG. 5 is a side view of the cutter device employed in the crossbow bolt of FIG. 1 with blades shown in the normal biased and splayed out orientation.
Figure 10:
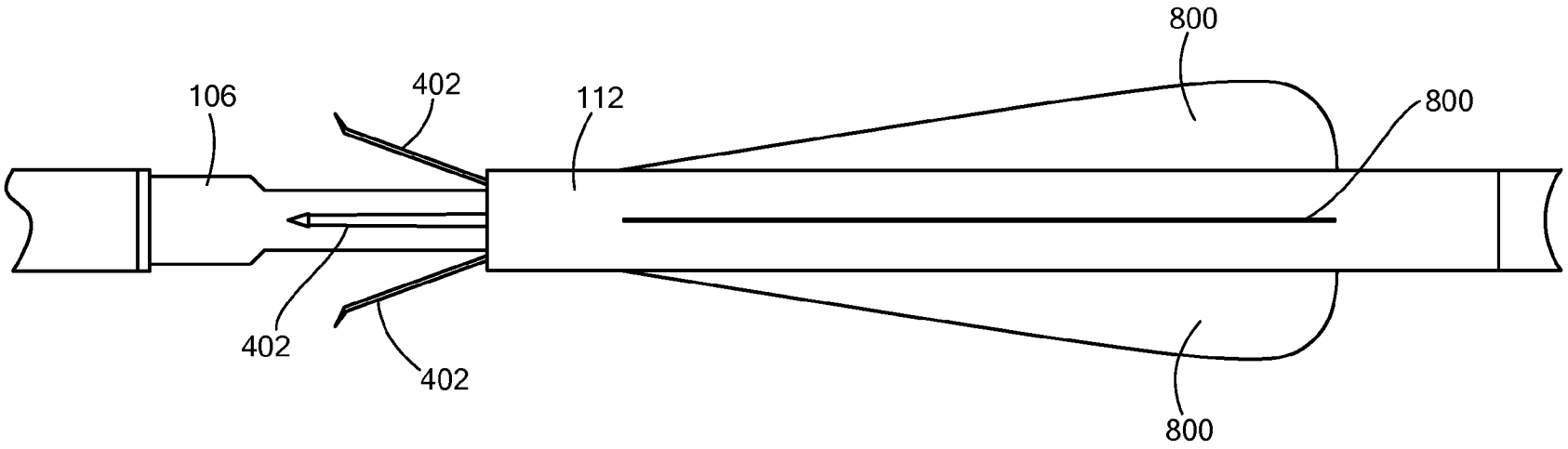
FIG. 10 is a top view illustrating the deployment of the blades upon rearward slidable movement of the tube.

Tabs 310 extend outward from the surface of the rearward end of the necked down mounting region 306 and serve to prevent forward movement of the ring shaped portion 400 of the cutter device 108 along the aft portion 106 once the ring shaped portion 400 is slidably disposed over the aft portion 106 of the bolt 100. The cutter device 108 has a thickness no greater than the spacing between the outer diameter of the necked down region 306 and the inner diameter of the tube 112 so as to permit the cutter device to be disposed within such spacing when the tube 112 is disposed over the mounting section 306. The cutter device may be fabricated of spring steel, stainless steel, a plastic or any other suitable material. The blades 402 are naturally bowed or splayed outward at the forward ends thereof as illustrated in FIG. 5 so that the blades will deploy outward of the necked down mounting region 306 as the tube 112 is urged slidably rearward upon impact of the vanes 800 with a target as depicted in FIG. 10. When the tube 112 is slidably disposed over the blades 402, the blades 402 are urged inward so as to reside generally parallel to the outer surface of the necked down mounting region 306 and within the spacing between the inner diameter of the tube 112 and the outer surface of the necked down mounting region 306.

Figure 7:
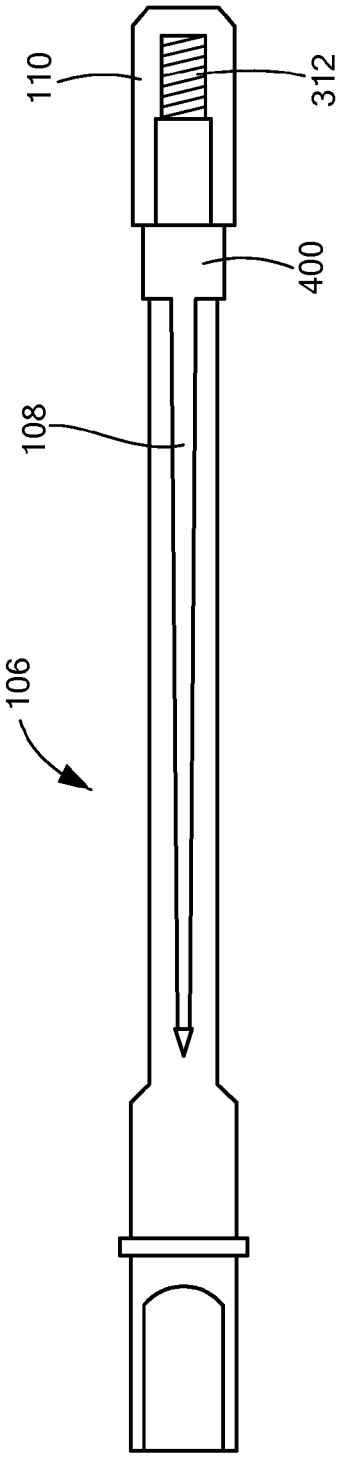
FIG. 7 is an side view of the aft portion of the bolt of FIG. 1 showing the cutter device mounted on the aft portion and retained by the end cap.
Figure 8:
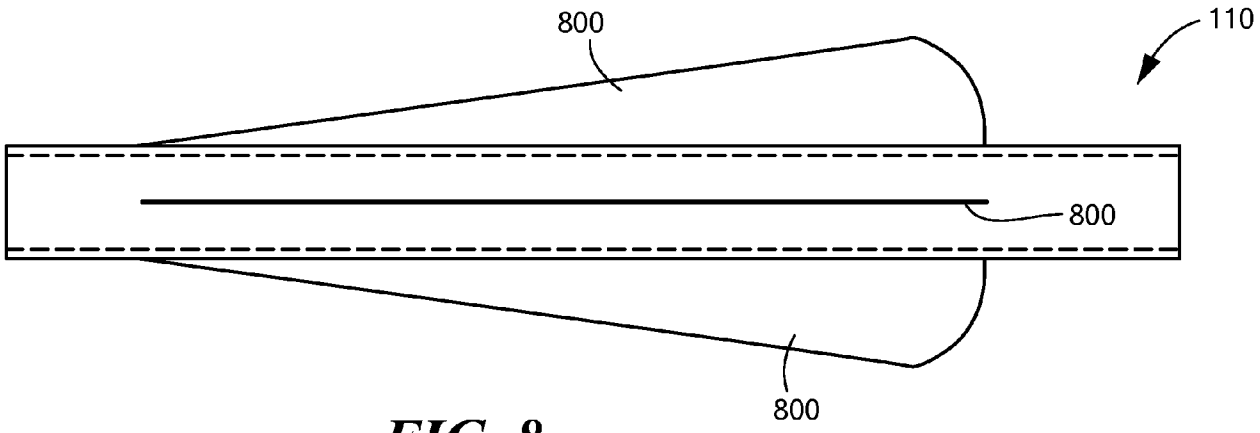
FIG. 8 is a top view of the tube having vanes extending therefrom.
Figure 9:
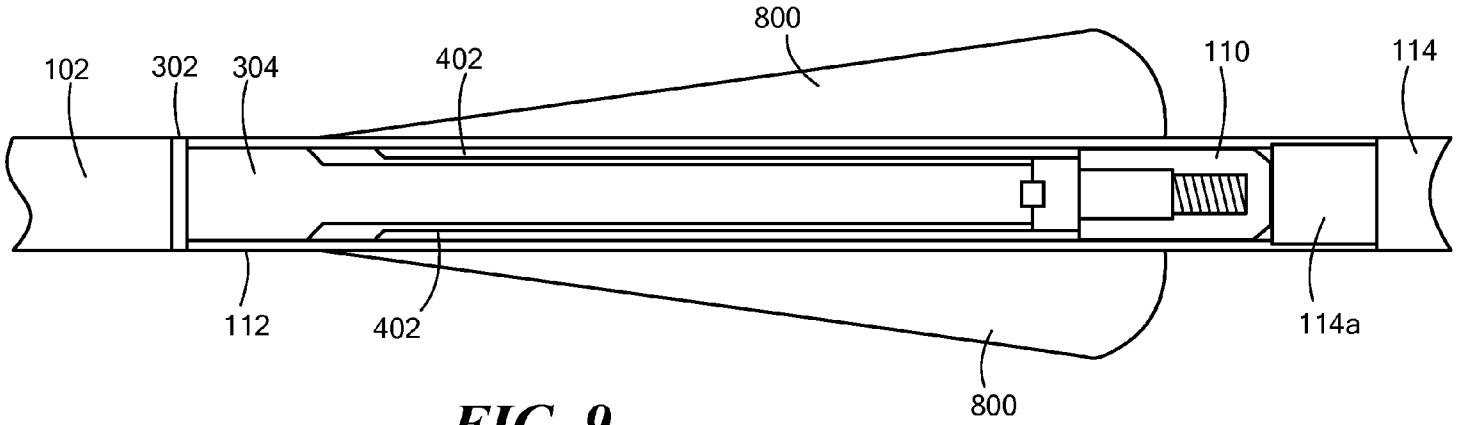
FIG. 9 is a schematic view illustrating the bolt of FIG. 1 with the cutter device secured between the outer diameter of the necked down mounting region of the aft portion of the bolt and the inner diameter of the tube as it would be oriented prior to launching of the bolt.

Once the cutter device 108 is mounted on the rearward and of the aft portion 106 with a leading edge of the ring-shaped portion 400 positioned against the tabs 310, end cap 110 is threaded onto a threaded stud 312 at the rearward end of the end cap mounting section 308 (FIG. 3) as illustrated in FIG. 7. When the end cap 110 is mounted to the rearward end of the aft portion 106, the forward edge of the end cap 110 abuts the rearward end of the cutter device 108 to prevent rearward movement of the cutter device 108 with respect to the aft portion 106 of the bolt 100. The outer diameter of the end cap 110 is substantially the same as the outer diameter of the cylindrical section 304 and such outer diameters generally correspond to the inner diameter of the tube 112. Thus, once the tube 112 is slidably disposed over the aft portion 106, the inner surface of the tube 112 is supported by and generally in abutting relation with the outer surfaces of both the cylindrical section 304 and the end cap 110 as illustrated in FIG. 9. The tube 112 has a plurality of vanes 800 extending therefrom to stabilize the bolt during flight. The vanes may be integrally molded with the tube as a single piece molded unit or, alternatively, affixed to the tube via a glue, adhesive, thermal welding or any other suitable process. The tube 112 is slidably disposed over the aft portion 106 with the forward end of the tube 112 in abutting relation with the annular flange 302 as depicted in FIG. 9. When so mounted, the rearward end of the tube 112 extends slightly beyond the rearward end of the end cap 110 as illustrated in FIG. 9. The nock 114 includes a forward section 114*a* having an outer diameter generally corresponding to the inner diameter of the tube 112 and is insertable into the rearward end of the tube 112.

When the bolt 100 is fired from a crossbow and penetrates a target animal to the point at which the hide of the target animal urges the vanes 800 rearward, the tube 112 slides rearward and the blades 402 of the cutter device 108 deploy outward as shown in FIG. 10. Once the blades 402 of the cutter device 108 deploy outward, they create a considerably larger wound in the target animal than would be produced by a conventional bolt that did not employ such a rear mounted cutter device. As a consequence, bolts in accordance with the present invention, cause a more rapid demise of the target animal.

Figure 11:
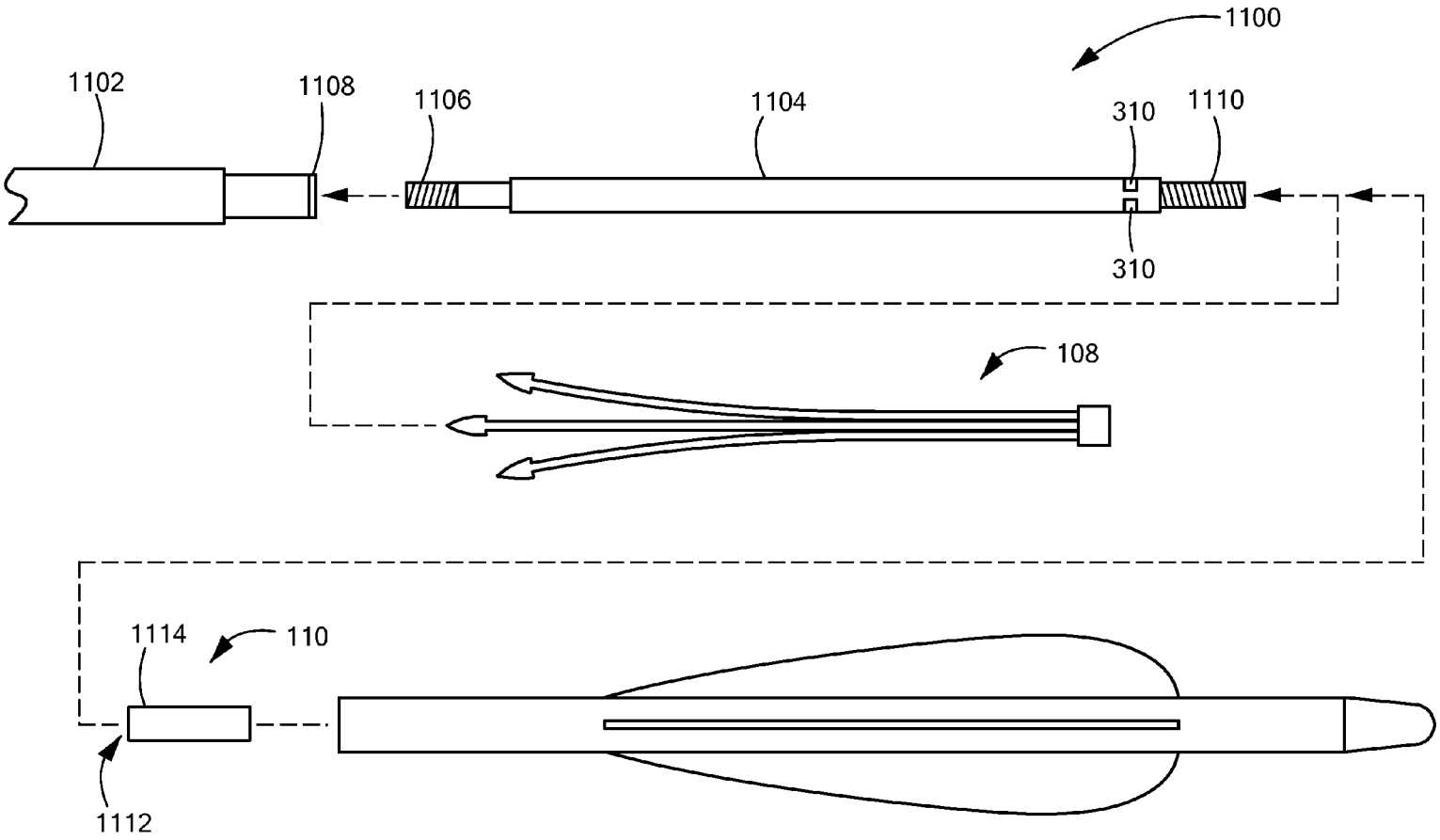
FIG. 11 is an exploded view of another embodiment of a bolt in which the front end of the aft portion of the bolt includes a threaded stud that is cooperative with a threaded opening in an insert provided in the rearward end of the forward portion of the bolt to releasably secure the aft portion to the forward portion.

In another embodiment illustrated in FIG. 11, the bolt 1100 includes a forward portion 1102 and an aft portion 1104 generally as described above. However, the front end of the aft portion 1104 includes a threaded stud 1106 that is threaded into a threaded opening provided in an insert 1108 mounted in the rearward end of the forward portion 1102 of the bolt 1100. In this manner, the aft portion 1104 may be removably affixed to the forward portion 1102 of the bolt 1100 by unscrewing the threaded stud 1106 from the insert 1108.

Figure 15A:
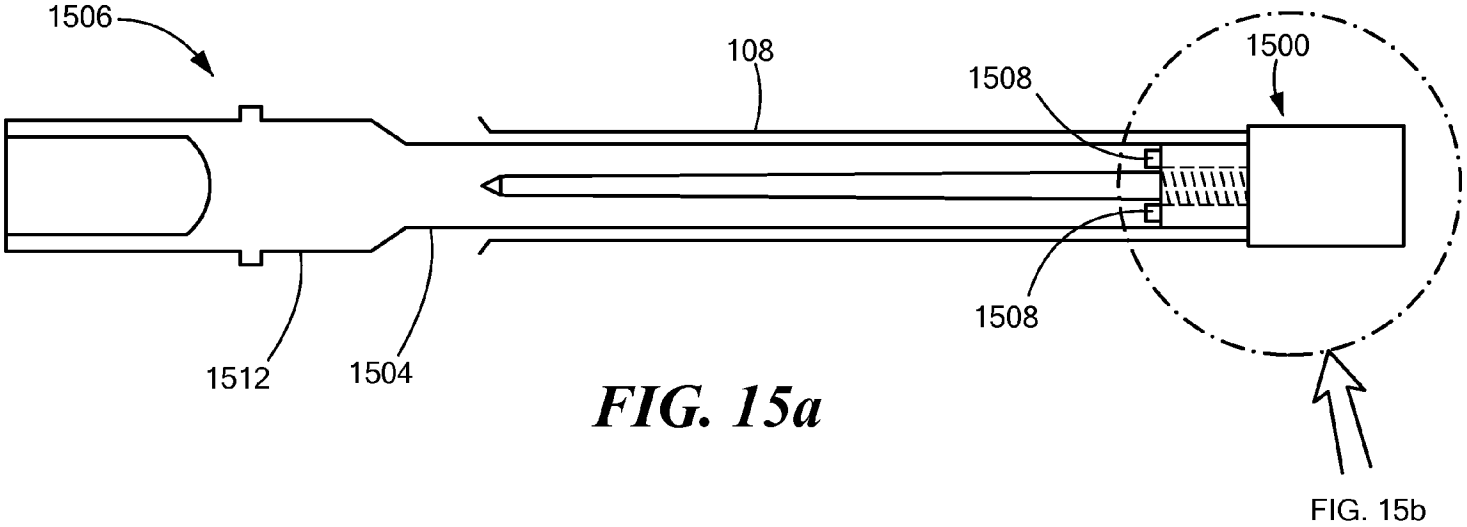
FIG. 15*a* is a schematic view of an aft portion and end cap assembly illustrating the mounting of a cutter device on the frontal portion of the end cap.
Figure 15B:
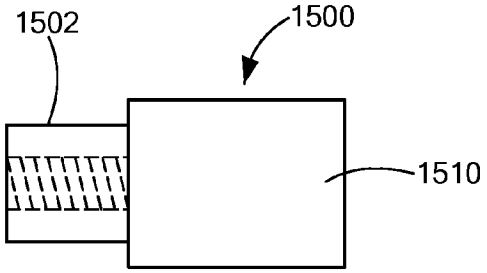
FIG. 15*b* is a side view of the end cap depicted in FIG. 15*a*.

In the above-described embodiments, the cutter device 108 is slidably disposed over the rearward end of the bolt and secured in position between tabs 310 and the front edge of the end cap 110. In another embodiment, illustrated in FIGS. 15*a* and 15*b* the cutter device 108 is mounted on an end cap 1500 that is secured to the rearward end of the bolt. More specifically, the end cap 1500 has a reduced diameter frontal section 1502 generally corresponding to the diameter of the necked down mounting region 1504 of the aft portion 1506. In this embodiment, tabs outwardly extending from the necked down mounting region 1504 at the rearward end of the aft portion 1506 prevent the cutter device 108 from sliding forward. The diameter of the rearward section 1510 of the end cap 1500 generally corresponds to the diameter of the cylindrical section 1512 thus forming a lip at the junction of the forward section and the rearward section of the end cap 1500 which prevents rearward movement of the cutter device 108. Thus, once the cutter device 108 is slidably disposed on the frontal portion of the end cap 1500 and the end cap is secured to the rearward end of the bolt, the cutter device is secured against forward or rearward movement. In this embodiment, the blades extend forward along the necked down mounting region and deploy as previously discussed. The tube 112 is slidably disposed over the aft portion 1506, the cutter device 108 and the end cap 1500 and is aligned and supported by the outer surfaces of the generally cylindrical section 1512 and the rearward section of the end cap 1510. A nock is mountable in the rearward end of the tube 112 as previously discussed. While in the illustrated embodiment, a threaded stud extends from the rearward end of the aft portion 1506 and is threaded into a threaded opening or insert in the frontal portion 1502 of the end cap 1500, it should be appreciated that a threaded stud may be provided which extends from the frontal portion of the end cap and which threads into a threaded opening or insert provided in the rearward end of the aft portion 1506.

Figure 12:
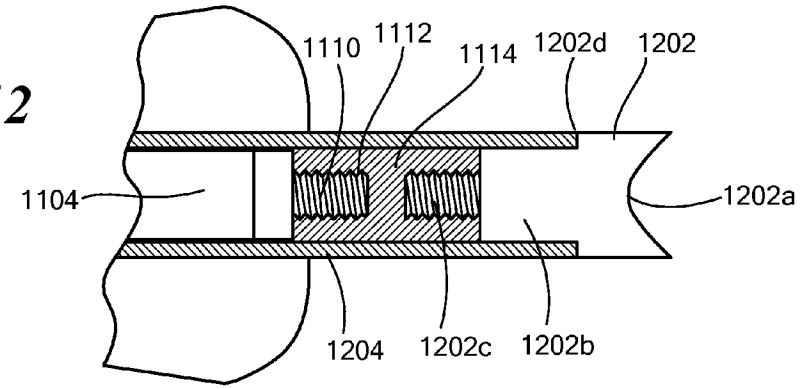
FIG. 12 is a cross-sectional view illustrating a nock and end cap cooperative to prevent deployment of the blades when using the bolt for practice.

As illustrated in FIG. 12, a practice arrow may be provided by securing the nock to the end cap to prevent slidable rearward movement of the tube and the associated deployment of the blades. More specifically, an end cap 1114 is provided with a threaded opening at its rearward end as well as a threaded opening at its front end. The threaded stud 1110 engages the threaded opening 1112 in the end cap 1114 (FIG. 11). A nock 1202 includes a bow string engaging portion 1202*a*, a generally cylindrical section 1202*b* having an outer diameter generally sized to provide a press fit when disposed within the rearward end of the tube 1204, and a threaded stud 1202*c* configured for threadable insertion in the threaded opening in the rearward end of the end cap 1114. The outer diameter of the bow string engaging portion 1202*a* has an diameter substantially equal to the outer diameter of the tube 1200 and the outer diameter of the generally cylindrical section 1202*b* has an outer diameter generally corresponding to the inner diameter or the tube 1204 so as to provide a lip 1202*d* at the junction of the bow string engaging portion 1202*a* and the generally cylindrical section 1202*b*. When the threaded stud 1202*c* is threaded into the end cap 1114, the lip 1202*d* prevents the rearward slidable movement of the tube 1204 with respect to the aft portion 1104 and thus prevents deployment of the blades upon engagement of the vanes with a target during practice.

While the embodiments described above include forward and aft portions that are coupled together to form a bolt shaft, it should be appreciated that the forward and aft portions may be fabricated as an integral single piece shaft.

It will further be appreciated that aft portion, cutter device, end cap, tube and nock or components selected therefrom and/or an insert for insertion in the rearward end of the forward portion may be provided as a kit to allow a hunter to modify an existing bolt to include a rear deployable cutter device in accordance with the present invention.

Figure 13:
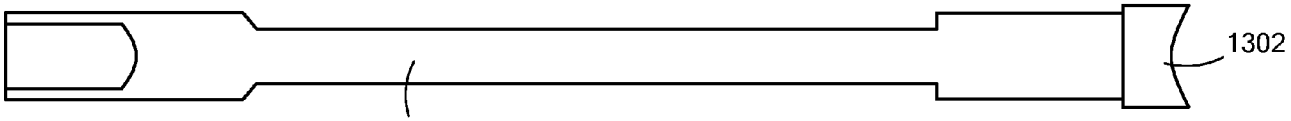
FIG. 13 is a side view of an insert mountable in the back end of a practice bolt.
Figure 14:
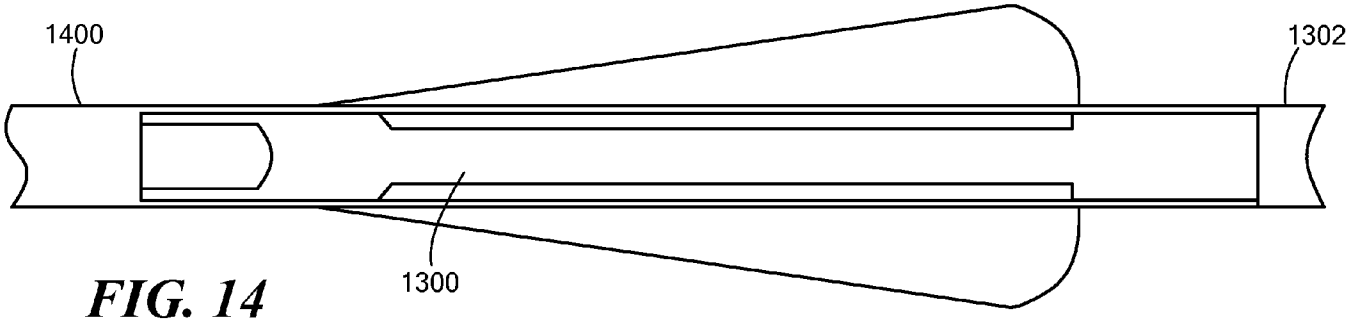
FIG. 14 is a cross-sectional view of a practice bolt including the insert of FIG. 13 that is mounted in the back end of the bolt and weighted to simulate the flight characteristics of a crossbow bolt having a rear deployable cutter device.

FIG. 13 depicts an insert 1300 that is mountable in the aft portion of a crossbow bolt. The insert is weighted so as to provide a practice bolt that is devoid of a rear deployable cutter device but which simulates the flight characteristics of a bolt having a rear deployable cutter device. In one embodiment, the practice bolt replicates the weight of a bladed version having a rear deployable cutter device and/or without multiple parts or tubes. More specifically, a center section 1300*a* of the insert 1300 may have a diameter that is greater than that of the bladed version to provide the desired weight of the insert. As illustrated in FIG. 14, the insert 1300 may be disposed into the rearward end of an uncut bolt 1400 and secured via glue, adhesive, epoxy or pressure fit. A nock 1302 may be molded or machined as an integral piece with the insert 1300 or alternatively, attachable to the insert 1300 to allow for the use of commercially available nocks. The insert illustrated in FIG. 13 may be machined or molded as an integral singular piece and may be fabricated from metal, plastic or any other suitable material.

FIG. 14 depicts the insert 1300 depicted in FIG. 13 mounted within a tubular bolt 1400. The insert 1300 may be secured within the tubular bolt 1400 via the use of glue, adhesive, epoxy or alternatively, via a press fit or any other suitable means. The use of a practice bolt fabricated as described allows for practice and sightings of shots without the presence of the rearward deployable cutter device.

While the invention has been described above in connection with a form of arrow known as a bolt, it should be understood that the construction described herein may also be employed with respect to arrows used with vertical type bows in addition to crossbows.

It will further be appreciated by those of ordinary skill in the art that modifications to and variations of the above-described arrows and methods of producing the same may be made without departing from the inventive concepts disclosed herein. Accordingly, the invention is not to be viewed as limited except by the scope and spirit of the appended claims.

What is claimed is:

1. An arrow comprising:

a forward portion having a first diameter, a front end and a rearward end;

an aft portion extending rearward from the forward portion, the aft portion having a front end and a rearward end, wherein the aft portion includes a necked down mounting region having a diameter less than the first diameter;

a cutter device having a mounting portion and at least one blade extending from the mounting portion, wherein the mounting portion is mounted to the rearward end of the aft portion of the arrow with the at least one blade extending forward toward the forward portion of the arrow and disposed generally along the necked down mounting region when the at least one blade is in a non-deployed orientation.

2. The arrow of claim 1 further including a tube disposed over the aft portion, wherein the tube maintains the at least one blade in the non-deployed orientation when disposed over the aft portion, the outer diameter of the tube being generally the same as the first diameter.

3. The arrow of claim 2 wherein the tube has a length and the tube includes a plurality of vanes mounted to the tube and extending longitudinally along at least a portion of the length of the tube.

4. The arrow of claim 3, wherein:

the inner diameter of the of the tube is cooperative with at least an outer diameter of a portion of the aft portion of the arrow so that the tube remains disposed over the aft portion of the arrow in flight and is slidable rearward as the vanes engage a target to expose the at least one blade of the cutter device; and the at least one blade is normally splayed outward from the mounting portion when not restrained by the tube and upon rearward slidable movement of the tube with respect to the aft portion, the at least one blade deploys outward from the necked down mounting region so as to engage the target.

5. The arrow of claim 1, wherein the cutter device is fabricated of spring steel, stainless steel or plastic.

6. The arrow of claim 1 wherein the cutter device includes three blades.

7. The arrow of claim 1 wherein the aft portion is coupled to the forward portion.

8. The arrow of claim 1 wherein the aft portion is removably coupleable to the forward portion.

* * * * *